US006803712B1

(12) United States Patent
Sato et al.

(10) Patent No.: US 6,803,712 B1
(45) Date of Patent: Oct. 12, 2004

(54) MATERIAL FOR SHADOW MASK, METHOD FOR PRODUCTION THEREOF, SHADOW MASK AND IMAGE

(75) Inventors: Taizo Sato, Yamaguchi-ken (JP); Toshiyuki Ueda, Yamaguchi-ken (JP); Shinichi Aoki, Yamaguchi-ken (JP)

(73) Assignee: Toyo Kohan Co., Ltd., Tokyo (JP)

( * ) Notice: Subject to any disclaimer, the term of this patent is extended or adjusted under 35 U.S.C. 154(b) by 0 days.

(21) Appl. No.: 09/936,289

(22) PCT Filed: Mar. 8, 2000

(86) PCT No.: PCT/JP00/01402

§ 371 (c)(1),
(2), (4) Date: Sep. 12, 2001

(87) PCT Pub. No.: WO00/55383

PCT Pub. Date: Sep. 21, 2000

(30) Foreign Application Priority Data

Mar. 12, 1999 (JP) ..... 11-066542

(51) Int. Cl.[7] ..... H01J 29/07; H01J 9/14; C22C 38/00

(52) U.S. Cl. ..... 313/402; 445/24; 430/4; 430/5; 430/323; 148/310; 148/336; 148/546

(58) Field of Search ..... 313/402, 407; 445/24; 430/4, 5, 323; 148/310, 336, 546

(56) References Cited

U.S. PATENT DOCUMENTS 5,002,619 A * 3/1991 Tsuda et al. ..... 148/649
5,209,900 A * 5/1993 Nakamura et al. ..... 420/94
5,532,088 A * 7/1996 Teshima et al. ..... 430/4
5,643,697 A * 7/1997 Baudry et al. ..... 430/5
6,258,496 B1 * 7/2001 Makita et al. ..... 430/23

OTHER PUBLICATIONS

Patent Abstracts of Japan, Publication No.: 02–254139, Oct. 12, 1990.

Patent Abstracts of Japan, Publication No.: 08–269627, Oct. 15, 1996.

Patent Abstracts of Japan, Publication No.: 01–136933, May 30, 1989.

* cited by examiner

*Primary Examiner*—Ashok Patel
*Assistant Examiner*—Sikha Roy
(74) *Attorney, Agent, or Firm*—Browdy and Neimark, P.L.L.C.

(57) ABSTRACT

A material for shadow mask having the following composition of components: C≦0.0008 wt %, Si≦0.03 wt %, Mn:0.1 to 0.5 wt %, P≦0.02 wt %, S≦0.02 wt %, Al:0.01 to 0.07 wt %, N≦0.0030 wt %, B: an amount satisfying the formula: 5 ppm≦B-11/14×N≦30 ppm, balance: Fe and inevitable impurities; a method for producing the material; a shadow mask using the material (cold rolled steel sheet); and an image receiving tube equipped with the shadow mask. The material has excellent etching characteristics, which are uniform within the same coil, and excellent press formability.

8 Claims, 1 Drawing Sheet

MATERIAL FOR SHADOW MASK, METHOD FOR PRODUCTION THEREOF, SHADOW MASK AND IMAGE

REFERENCE TO RELATED APPLICATIONS

The present application is the national stage under 35 U.S.C. §371 of international application PCT/JP00/01402, filed Mar. 8, 2000 which designated the United States, and which application was not published in the English language.

TECHNICAL FIELD

The present invention relates to a cold rolled steel sheet used as shadow mask material for a color picture tube, a method for manufacturing the cold rolled steel sheet, a shadow mask utilized with the cold rolled steel sheet and a picture tube with the shadow mask.

BACKGROUND OF THE INVENTION

A cold rolled steel sheet used for shadow mask material has been manufactured by the following manufacture steps. That is, low carbon steel manufactured by a steel maker is performed by pickling and cold rolling so as to form a steel sheet having a predetermined thickness. After degreasing, the steel sheet is decarbonized and annealed in a wet atmosphere in a box type anneal furnace. Then, the steel sheet is secondary cold rolled so as to form a furnish steel sheet with a final thickness.

The cold rolled steel sheet manufactured by such a method is installed in a picture tube after being treated by photo etching, annealing, pressing and baking. Unless carbon originally contained in the cold rolled steel sheet is decarbonized sufficiently during the above described steps, improper etching and improper press forming would be induced. Therefore, a content ratio of decarbonized and annealed carbon should be equal or less than 0.0015 wt %, preferably equal or less than 0.0008 wt %.

Regarding a cold rolled steel sheet used for a shadow mask manufactured by a method comprising the above described etching and press forming steps, it has been required that etching performance and press forming performance should be more stable than the conventional ones since a picture tube is required to provide high picture quality and improve its fine degree. Japanese Patent Laid-open Publication No. Shou 56-139624, No. Hei 2-61029 and No. Hei 8-269627 discloses a method to resolve such a problem, respectively. In the above prior art, although steel components and annealing condition are described, these are not sufficient to provide stable etching performance and press forming performance in order to satisfy recent requirements with respect to the shadow mask material such as high picture quality and its fine improvement.

A purpose of the invention is to resolve the above described drawbacks in the conventional art and to provide shadow mask material with characteristic uniformly etched in a coil and press forming characteristic installed in a picture tube.

DISCLOSURE OF THE INVENTION

Shadow mask material according to the present invention is comprises nitrogen equal to or less than 0.0030 wt %, boron satisfying an inequality of 5 ppm≦B−11/14×N≦30 ppm and the residue including iron and unavoidable impurities. Shadow mask material according to the present invention comprises carbon equal to or less than 0.0008 wt %, silicon equal to or less than 0.03 wt %, manganese from 0.1 to 0.5 wt %, phosphorus equal to or less than 0.02 wt %, sulfur equal to or less than 0.02 wt %, aluminum from 0.01 to 0.07 wt %, nitrogen equal to or less than 0.0030 wt % and boron satisfying an inequality of 5 ppm≦B−11/14×N≦30 ppm and the residue including iron and unavoidable impurities.

A method for manufacturing shadow mask material made of a steel sheet according to the present invention comprising nitrogen equal to or less than 0.0030 wt %, boron satisfying an inequality of 5 ppm≦B−11/14×N≦30 ppm and the residue including iron and unavoidable impurities, wherein a hot rolling furnish is higher than a point $Ar_3$, comprises hot rolling the steel sheet at a coiling temperature from 540 to 680° C. The sheet is then pickled, and then the steel sheet is annealed in a continuous annealing step so as to control the amount of carbon remaining as equal to or less than 0.0008 wt %.

A method for manufacturing shadow mask material made of a steel sheet according to the present invention is comprising carbon equal to or less than 0.0008 wt %, silicon equal to or less than 0.03 wt %, manganese from 0.1 to 0.5 wt %, phosphorus equal to or less than 0.02 wt %, sulfur equal to or less than 0.02 wt %, aluminum from 0.01 to 0.07 wt %, nitrogen equal to or less than 0.0030 wt % and boron satisfying an inequality of 5 ppm≦B−11/14×N≦30 ppm and the residue including iron and unavoidable impurities, wherein a hot rolling finish is higher than a point $Ar_3$, comprises hot rolling said steel sheet at a coiling temperature from 540 to 680° C. The sheet is then pickled, and then said steel sheet is annealed in a continuous annealing step so as to control the amount of carbon remaining at equal to or less than 0.0008 wt % A shadow mask according to the present invention is characterized of comprising the above described shadow mask material. A picture tube according to the present invention is characterized comprising the above described shadow mask.

BEST MODE FOR CARRYING OUT THE INVENTION

Figure 1:
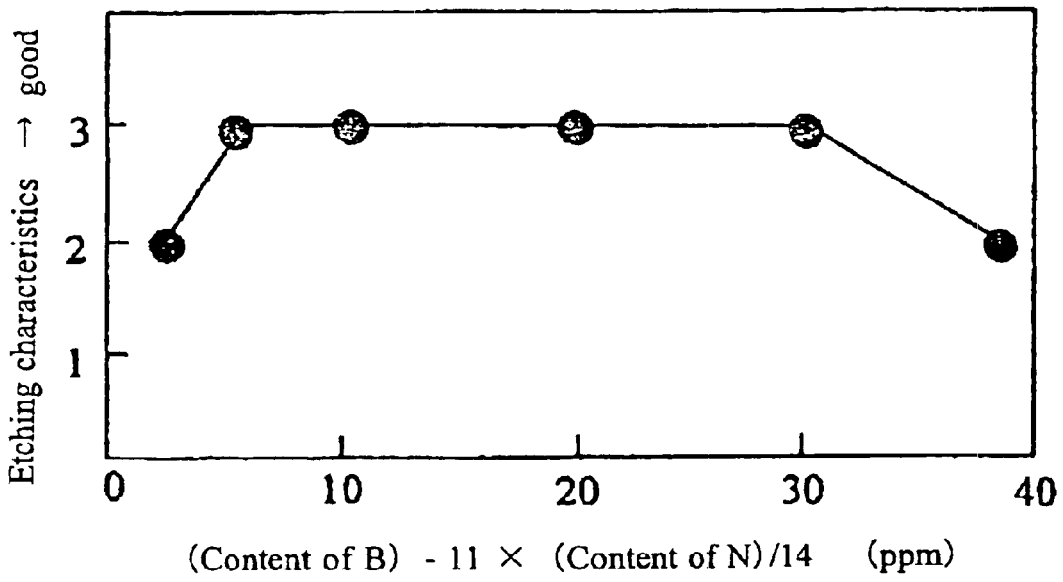
FIG. 1 is a graph for showing a relation of an etching characteristic and an inequality of amounts of boron and nitrogen.

Regarding chemical composition of the hot rolled steel sheet, the following chemical composition are preferable. That is, a steel sheet comprises nitrogen equal to or less than 0.0030 wt %, boron satisfying an inequality of 5 ppm≦B−11/14×N≦30 ppm and the residue including iron and unavoidable impurity.

N: 0.0030 wt %

Nitrogen in steel makes nitride with aluminum. On the other hand, the aging effect of the steel is reduced by decreasing solid soluble nitrogen. Therefore, it is preferable that the amount of nitrogen be as low as possible. In order to maintain the press forming characteristic as shadow mask material, it is necessary that the amount of nitrogen be remarkably low and it is preferable that the upper limit be 0.0030 wt %, more preferable 0.0020 wt %.

Boron: 5 ppm≦$B$−11/14×$N$≦30 ppm

Boron in steel uniforms crystal grain in a thin steel sheet so that excellent etching characteristic can be obtained as shadow mask material. Particularly, boron makes a big effect with respect to an extremely thin shadow mask having a thickness of 0.1 to 0.2 mm which has been used recently.

It is preferable that boron be added to the steel since boron is an effective element so as to fix solid soluble nitrogen. On the other hand, if an amount of boron is too much, crystal grains are extremely fine and its magnetic characteristic is adversely influenced. Therefore, it is preferable that the amount of boron be within a predetermined range.

In the present invention, it is preferable that the content of boron be satisfied with the above inequality. If the content ratios of nitrogen and boron are within the above described ranges, respectively, an excellent etching characteristic can be obtained as shown in FIG. 1. Further, in the present invention, it is preferable that the following chemical composition of a hot rolled steel sheet be controlled, as a steel sheet having a thickness of 0.08 to 0.2 mm is suitable for an extremely thin shadow mask.

That is, the content of carbon is equal to or less than 0.0030 wt %, the content of silicon is equal to or less than 0.03 wt %, the content of manganese is from 0.1 to 0.5 wt %, the content ratio of phosphorus is equal to or less than 0.02 wt %, the content ratio of sulfur is equal to or less than 0.02 wt % and the content ratio of aluminum is from 0.01 to 0.07 wt %. The reason for the above ratios will be described hereinafter.

Carbon: ≦0.0030 wt %

The amount of carbon in hot rolled steel sheet is much influenced by a continuous annealing step for decarbonizing. If the content of carbon exceeds 0.0030 wt %, carbon can not be decarbonized sufficiently in the continuous annealing step. To provide shadow mask material in which the content of carbon is equal to or less than 0.0008 wt %, an annealing temperature has to be increased and an annealing time has to be extended. Therefore, the manufacturing cost would become higher and a productivity would become lower. It is preferable that the upper limit be 0.0030 wt %, more preferably 0.0020 wt %.

Silicon: ≦0.03 wt %

Silicon contained in shadow mask material is an element to prevent shadow mask material from blackening in a blackening treatment for manufacturing a picture tube. Although the content is preferably as low as possible, silicon is an unavoidable element of an aluminum killed steel. It is preferable that the upper limit be 0.03 wt %, more preferably 0.02 wt %.

In hot rolled steel, manganese is necessary to prevent silicon as an impurity from becoming red, thermal, and brittle in a hot rolling step. In the case of an extreme thin shadow mask material according to the present invention, the material is apt to be cracked in a cold rolling step. Therefore, it is preferable to add a predetermined amount of manganese. The content of manganese is preferably equal to or more than 0.1 wt %, more preferably equal to or more than 0.2 wt %, and further preferably equal to or more than 0.25 wt %. On the other hand, the upper limit of the content of manganese is preferably 0.5 wt %, more preferably 0.4 wt % and further more preferably 0.35 wt %, since the forming characteristic is adversely affected if the content exceeds 0.6 wt %.

In the shadow mask material, phosphorus reduces the size of crystal grains so that the magnetic characteristic becomes worse. It is preferable that the ratio of phosphorus be as low as possible. Particularly, in such an extreme thin shadow mask material according to the present invention, phosphorus is seriously adversely affected so that, the content of phosphorus is preferably equal to or less than 0.02 wt %.

In hot rolled steel, sulfur is an unavoidable element and impurity so as to make the steel red, thermal, and brittle. It is earnestly preferable that the content of sulfur be as low as possible. Particularly, in such an extreme thin shadow mask material according to the present invention, the material is apt to be cracked in a cold rolling step. Therefore it is preferable to avoid sulfur as much as possible. To avoid the above phenomenon, the upper limit is preferably 0.02 wt %, more preferably 0.015 wt % and further more preferably 0.01 wt %.

Aluminum: 0.01 to 0.07 wt %

In a step of manufacturing hot rolled steel, aluminum is added to molten steel as a deoxidizer and then removed as slag. Unless the added amount of aluminum is sufficient, a certain deoxidization effect can not be obtained. It is preferable that aluminum be added affirmatively so as to form aluminum nitride in a hot rolling step and an annealing step and to prevent solid soluble nitrogen from aging by fixing nitrogen. Particularly in the case of the extreme thin shadow mask material according to the present invention, the material is apt to be cracked caused by including impurity such as oxide in a cold rolling step. Therefore, it is necessary to add aluminum as much as possible. The lower limit is preferably 0.01 wt %, more preferably 0.02 wt %. On the other hand, even if the content of aluminum exceeds 0.07 wt %, the above effect can not be improved so much. Such redundant aluminum induces to increase recrystallization temperature and to increase the amounts of the inclusion. The upper limit is preferably 0.07 wt %, more preferably 0.05 wt %, further more preferably 0.04 wt %.

Residue: Iron and avoidable elements without influencing the etching characteristic and the press formation characteristic are not restricted.

A method for manufacturing an extreme thin shadow mask material according to the present invention will be described. Although a slab heating temperature and a hot rolling condition are not so restricted in the present invention, the slab heating temperature is preferably hotter than 1100° C. so as to keep a hot rolling temperature since a hot rolling property becomes worse if the slab heating temperature is less than 1100° C. On the other hand, if the slab heating temperature is too high, nitride disolves and becomes solid soluble again. The slab heating temperature is preferably less than 1220° C.

If the hot rolling furnish temperature is equal to or less than $Ar_3$, crystal grains are mixed and become big in a crystal structure of a hot rolled steel sheet so that the etching characteristic and the press forming characteristic are deteriorated. The hot rolling furnish temperature is preferably higher than $Ar_3$.

A lower limit of a coiling temperature is preferably 540° C. aspect from a point of quality stability of a hot rolled steel sheet along a width direction and a longitudinal direction of a coil in a hot rolling step. On the other hand, if the coiling temperature exceeds 680° C., descaling characteristic is deteriorated. The coiling temperature is preferably from 540° C. to 680° C.

(Pickling, First Cold Rolling Step)

Pickling and first cold rolling step may be normal conditions. In order to decarbonize and anneal an extreme thin shadow mask material according to the present invention effectively, the thickness of a steel sheet after the first cold rolling is preferably equal to or less than 0.6 mm and more preferably equal to or less than 0.5 mm.

A continuous annealing step is an important step in the present invention. The continuous annealing step is preferably operated in a condition wherein a sheet temperature is equal to or more than 750° C., a soaking period is equal to or more than 60 seconds, the content of hydrogen is from 0 to 75% and the residue is nitrogen gas in the annealing atmosphere and the dew point is from −30° C. to 70° C.

The Annealing Temperature influences the decarbonization effect and the etching characterisitic. If the annealing temperature is less than 750° C., it takes a long time to decarbonize. In addition to reducing the productivity the structure of recrystallization after annealing becomes uneven so that a uniform etching characteristic can not be obtained. Accordingly, the annealing temperature is preferably equal to or higher than 750° C.

(Annealing Time)

Annealing time is preferably equal to or more than 60 seconds. If the annealing time is less than 60 seconds, the decarbonization with respect to the extreme thin shadow mask material is insufficient so that the content of the carbon can not be reduced to a target level equal to or less than 0.0008 wt %. Although the upper limit is not necessarily restricted, the annealing time is preferably equal to or less than 120 seconds aspect from a point of the productivity and an avoidance of big grains.

If the content ratio of hydrogen gas in the continuous annealing atmosphere can be maintained equal to or less than 70%, a content of carbon in the extreme thin shadow mask material can be reduced to a level equal to or less than 0.0008%. Even if the content of hydrogen gas exceeds 70%, the decarbonization time is not so changed and the manufacturing cost is increased. The upper limit of the content of hydrogen gas is preferably 70%. In the case that the dew point is in a range from −30° C. to 70° C., the content of carbon in the extreme thin shadow mask material is equal to or less than 0.0008%.

(Secondary Cold Rolling After Annealing)

Reduction ratio of secondary cold rolling after annealing is preferably from 41% to 90% so as to provide necessary strength for an extreme thin shadow mask material. If the reduction ratio is equal to or less than 40%, the necessary strength can not be obtained. If the rolling ratio is equal to or more than 91%, the number of rolling steps is increased and the productivity is reduced. Therefore, the upper limit is preferably 90%. Through the secondary cold rolling, the furnish thickness of the extreme thin shadow mask material becomes from 0.1 to 0.2 mm.

EXAMPLES

Examples according to the present invention will be described as below. Steel sheet having chemical composition as shown in Table 1 is hot rolled so as to form a hot rolled steel sheet having a thickness of 2.3 mm. After pickling, the steel sheet is cold rolled so as to form a cold rolled steel sheet having a thickness of 0.3 mm. During a continuous annealing step, decarbonization annealing is operated under various conditions. Table 2 shows annealing condition and a content ratio of carbon after annealing with respect to each example. Further, the extreme thin shadow mask material having a thickness of 0.1 mm is formed by the cold rolling.

TABLE 1

| Steel | Chemical composition (wt %) | | | | | | | | |
|---|---|---|---|---|---|---|---|---|---|
| sheet no. | C | Si | Mn | P | S | Al | N | B | Fe |
| 1 | 0.0021 | 0.03 | 0.36 | 0.017 | 0.017 | 0.041 | 0.0017 | 0.0021 | Residue |
| 2 | 0.0021 | 0.02 | 0.22 | 0.017 | 0.018 | 0.045 | 0.0023 | 0.0030 | Residue |
| 3 | 0.0024 | 0.02 | 0.30 | 0.010 | 0.016 | 0.048 | 0.0021 | 0.0021 | Residue |
| 4 | 0.0018 | 0.03 | 0.33 | 0.013 | 0.012 | 0.051 | 0.0010 | 0.0013 | residue |

TABLE 2

| Example or comparative example | Steel sheet no. | Annealing temperature (° C.) | Annealing time (second) | Content ratio of hydrogen gas (%) | Wet point (° C.) | Carbon content ratio in steel after annealing |
|---|---|---|---|---|---|---|
| Example 1 | 1 | 760 | 60 | 5 | 20 | 0.0007 |
| Example 2 | 1 | 775 | 60 | 5 | 20 | 0.0006 |
| Example 3 | 1 | 800 | 60 | 50 | −30 | 0.0005 |
| Example 4 | 2 | 775 | 60 | 5 | 20 | 0.0006 |
| Example 5 | 3 | 775 | 60 | 5 | 20 | 0.0006 |
| Example 6 | 4 | 775 | 60 | 5 | 20 | 0.0006 |
| Comparative example 1 | 1 | 725 | 80 | 5 | 20 | 0.0011 |
| Comparative example 2 | 1 | 760 | 30 | 5 | 20 | 0.0014 |
| Comparative example 3 | 1 | 760 | 60 | 5 | −40 | 0.0010 |

In the next, a shadow mask used with the above described material will be described. Water soluble casein-resist is coated on the both surfaces of the shadow mask material. Then, dried resist coated on the both surfaces is patterned by a pair of dry plates on which ins and outs patterns are drawn. After patterning, an exposure treatment, a film hardening treatment and a baking treatment are operated. Then, ferric chloride solution (solution temperature 60° C., specific gravity 48° Be) is sprayed on the both patterned resist surfaces as etching solution so as to etch the shadow mask material. After etching, the steel sheet is cleaned with alkaline solution so as to peel the resist. In the last, the shadow mask is manufactured by cleaning and drying. The result of the evaluation of the etching characteristic is shown in FIG. 1. In FIG. 1, a vertical axis indicates etching characteristic and a horizontal axis indicates a relation between amounts of boron and nitrogen. Judging from FIG. 1, an excellent etching characteristic can be obtained while the relation between the amount of boron and nitrogen satisfies the inequality of $5\ \text{ppm} \leqq B\text{-}11/14 \times N \leqq 30\ \text{ppm}$.

In FIG. 1, the etching characteristic is evaluated as three ranked standard in accordance with a shape of etched hole.

Evaluation point 3—good: profile of slot hole in view from an etching surface does not have any practical problem.

Evaluation point 2—intermediate: profile of slot hole in view from an etching surface is a little uneven.

Evaluation point 1—poor: profile of slot hole in view from an etching surface is deformed.

In the next, a condition in which the shadow mask according to the present invention is attached to a frame will be described. The shadow mask according to the present invention is fixed on the frame while tensile force is loaded. Although various methods for fixing a shadow mask on a frame can be considered, a welding method is the best known method. Initially, while a center portion of each upper and lower frame bars of a frame is forcibly flexed toward an inward direction, a shadow mask is fixed on the frame. Then, flexed upper and lower frame portions are returned to original positions, respectively (releasing forcibly force) so that tensile force can be applied to the shadow mask along an upper-lower direction.

When the shadow mask is fixed on the frame as described above, it is preferable that tensile force along a right-left direction of which amount is less than the tensile force along the upper-lower direction be loaded. In a picture tube according to the present invention, it is preferable that strong tensile force be applied along the upper-lower direction. In addition to the load in the upper-lower direction, the tensile force is loaded in the right-left direction. Thus the shadow mask can be prevented from crinkling by applying the tensile force along the upper-lower direction. However, if the large amount of tensile force were applied on the shadow mask along the right-left direction, slot holes formed on the shadow mask would be deformed.

POSSIBILITY OF USE IN THE INVENTION

Unless the carbon amount is decarbonized sufficiently, etching becomes uneven in an etching step for manufacturing a shadow mask. Thereby, profile of etched holes does not become uneven and unevenness of the surface become large. Unless the carbon amount is equal or less than 0.0008%, the sufficient etching characteristic can not be obtained. If the carbon content is too much, the shadow mask material becomes hard and a shape freezing characteristic is deteriorated in a press forming step. Therefore, the carbon amount should be lowered.

As shown in FIG. 1, boron can fix nitrogen and prevent nitrogen from occurring stretcher strain caused by aging solid soluble nitrogen and uniform recrystallization grains. In order to stabilize the etching characteristic, a necessary amount of boron is required to add to the material. However, if the added amount of boron is too much, high crystal grains become extremely fine so that the high qualification and the magnetic characteristic are adversely affected.

What is claimed is:

1. Shadow mask material consisting of carbon equal to or less than 0.0008 wt %, silicon equal to or less than 0.03 wt %, manganese from 0.1 to 0.5 wt %, phosphorus equal to or less than 0.02 wt %, sulfur equal to or less than 0.02 wt %, aluminum from 0.01 to 0.07 wt %, nitrogen equal to or less than 0.0030 wt % and boron satisfying an inequality of boron 5 ppm$\leqq$B−11/14×N$\leqq$30 ppm and the residue including iron and unavoidable impurities, wherein a hot rolling furnish is higher than point $Ar_3$, and said steel sheet is hot rolled at a coiling temperature of from 540 to 680° C. and cold rolled after pickling, and then said steel sheet is annealed in a continuous annealing step, wherein the annealing is conducted at a sheet temperature equal to or greater than 750° C., a soaking period is from 60 to 120 seconds, hydrogen is present in the annealing gas in an amount of from 0 to 75% and the residue is nitrogen and a dew point is from −30° C. to 70° C., so as to control the amount of carbon to not more than 0.0008 wt %.

2. Shadow mask made of the material as claimed in claim 1.

3. A picture tube with said shadow mask as claimed in claim 2.

4. Shadow mask material consisting of iron and unavoidable impurities, carbon equal to or less than 0.0008 wt %, silicon equal to or less than 0.03 wt %, manganese from 0.1 to 0.5 wt %, phosphorus equal to or less than 0.02 wt %, sulfur equal to or less than 0.02 wt %, aluminum from 0.01 to 0.07 wt %, nitrogen equal to or less than 0.0030 wt %, and boron satisfying the inequality of 5 ppm$\leqq$B−11/14×N$\leqq$30 ppm.

5. A shadow mask made of the material as claimed in claim 4.

6. A picture tube with said shadow mask as claimed in claim 5.

7. The shadow mask material according to claim 1 wherein the amount of boron is from 0.0013 to 0.0053 weight %.

8. The shadow mask material according to claim 4 wherein the amount of boron is from 0.0013 to 0.0053 weight %.

* * * * *